US006231808B1

(12) United States Patent
Hashikura et al.

(10) Patent No.: US 6,231,808 B1
(45) Date of Patent: May 15, 2001

(54) TOUGH AND HEAT RESISTING ALUMINUM ALLOY

(75) Inventors: Manabu Hashikura; Hisao Hattori; Toshihiko Kaji; Yoshishige Takano, all of Hyogo (JP)

(73) Assignees: Sumitomo Electric Industries, Ltd., Osaka; Japan Science and Technology Corporation, Saitama, both of (JP)

( * ) Notice: Subject to any disclaimer, the term of this patent is extended or adjusted under 35 U.S.C. 154(b) by 0 days.

(21) Appl. No.: 09/069,120

(22) Filed: Apr. 29, 1998

(30) Foreign Application Priority Data

Apr. 30, 1997 (JP) ..... 9-112003

(51) Int. Cl.[7] ..... C22C 21/00
(52) U.S. Cl. ..... 420/528; 420/552
(58) Field of Search ..... 148/415, 437; 420/552, 528

(56) References Cited

U.S. PATENT DOCUMENTS

| | | | | |
|---|---|---|---|---|
| 4,715,893 | * | 12/1987 | Skinner et al. | 75/249 |
| 5,431,751 | * | 7/1995 | Okochi et al. | 148/437 |
| 5,458,700 | * | 10/1995 | Masumoto et al. | 148/403 |
| 5,578,144 | * | 11/1996 | Satou et al. | 148/415 |
| 5,607,523 | | 3/1997 | Masumoto et al. | 148/415 |

FOREIGN PATENT DOCUMENTS

| | | |
|---|---|---|
| 0534470 | 3/1993 | (EP) . |
| 0570910 | 11/1993 | (EP) . |
| 0638657 | 2/1995 | (EP) . |
| 0675209 | 10/1995 | (EP) . |
| 6-21326 | 3/1994 | (JP) . |

OTHER PUBLICATIONS

Massalski, T. B., ed. Binary Alloy Phase Diagrams. American Society for Metals:Ohio. vols. 1 and 2, 1986. Pps 748, 1465, 1477, 2161.*

* cited by examiner

*Primary Examiner*—Roy King
*Assistant Examiner*—Tima McGuthry-Banks
(74) *Attorney, Agent, or Firm*—Sughrue, Mion, Zinn, Macpeak & Seas, PLLC

(57) ABSTRACT

A tough and heat resisting aluminum alloy comprising aluminum, a transition metal element and a rare earth element, and having a modulated structure which comprises an aluminum matrix and an intermetallic compound precipitated to form a network in the aluminum matrix. Also disclosed in a process for producing the aluminum alloy which comprises the steps of: rapid quenching and solidifying a liquid aluminum alloy at a quenching rate of $10^2$ to $10^5$ K/sec to obtain an aluminum-based supersaturated solid solution; and heat treating the quenched aluminum-based supersaturated solid solution at a heat treating temperature of 473 K or higher, the temperature increasing rate to the heat treating temperature being 1.5 K/sec or higher.

2 Claims, 8 Drawing Sheets

TOUGH AND HEAT RESISTING ALUMINUM ALLOY

FIELD OF THE INVENTION

This invention relates to an aluminum alloy having high toughness and excellent heat resistance which can be used as a part or a structural material required to have high toughness.

BACKGROUND OF THE INVENTION

Various studies have been given to high strength aluminum alloys obtained from an alloy containing amorphous metal, a supersaturated solid solution, and microcrystalline metal which is obtained by rapid quenching. For example, JP-B-6-21326 (the term "JP-B" as used herein means an "examined published Japanese patent application") discloses that a rapid quenching and solidification of a ternary alloy represented by the formula $Al_aM_bX_C$ (wherein M represents at least one element selected from Cr, Mn, Fe, Co, Ni, Cu, Zr, Ti, Mg and Si; X represents at least one element selected from Y, La, Ce, Sm, Nd, Nb and Mm (mish metal); a, b, and c are atomic percentages, in which a is from 50 to 95, b is from 0.5 to 35 and c is from 0.5 to 25) yields an amorphous alloy or a composite of amorphous matter and microcrystalline matter, each having a tensile-strength of from 853 to 1010 MPa (from 87 to 103 kgf/mm$^2$) and a yield strength of from 804 to 941 MPa (from 82 to 96 kgf/mm$^2$).

The resulting aluminum alloy has a high tensile strength which is twice or more that of conventional crystalline aluminum alloys, but its Charpy impact strength is less than about one fifth of that of conventional ingot aluminum.

JP-A-5-1346 (the term "JP-A" as used herein means an "unexamined published Japanese patent application) discloses that an aluminum alloy having a tensile strength of from 875 to 945 MPa (from 89.2 to 96.3 kgf/mm$^2$) and an elongation in tensile test of from 1.7 to 2.9% is obtained by rapid quenching and solidifying an alloy system represented by the formula $Al_aM_bLn_c$ or $Al_aM_bX_dLn_c$ (wherein M is at least one element selected from Co, Ni and Cu; Ln is at least one element selected from Y, rare earth elements and Mm; and X is at least one element selected from V, Mn, Fe, Mo, Ti and Zr). The metallographic structure of the alloy has an average grain size of from 0.1 to 80 $\mu$m. The matrix is aluminum or a supersaturated solid solution of aluminum, and fine particles of an intermetallic compound in a stable or metastable phase having a particle size of 10 to 500 nm are distributed in the matrix. The term "matrix" as used in the present invention means the host phase which encloses the other phase therewith.

In the case of the alloy disclosed in JP-A-5-1346-in which fine intermetallic compound particles at- the order of nanometers are dispersed in the supersaturated solid solution matrix, the finely dispersed intermetallic compound particles expand upon application of heat. Therefore, the toughness of the aluminum alloy is considerably reduced at a certain temperature or higher.

Therefore, the aluminum alloys described in JP-B-5-21326 and JP-A-5-1346 are both unsuitable for use as a material for machine parts and automotive parts that are required to have high reliability.

In order to overcome the above problems, the present inventors have studied the microstructures of aluminum alloys in the order of nanometers and their mechanical characteristics. They have found that, when a conventional supersaturated solid solution is heat-treated, there is produced a clear crystalline grain boundary between a precipitated intermetallic compound and the Al matrix, and the anchoring of dislocation upon plastic deformation concentrates at the grain boundary. This interferes the attempt to increase the toughness.

The inventors considered that concentration of dislocation anchoring might be prevented by using a modulated structure (a microstructure having regular fluctuations in concentration) having no clear boundaries between an intermetallic compound and an Al matrix. It was revealed that such a modulated structure exhibits high toughness while the intermetallic compound is precipitating, but the toughness is considerably reduced with the progress of precipitation till complete precipitation. This is because clear crystalline grain boundaries are formed between the Al matrix and the precipitate at the completion of precipitation, and dislocations upon plastic deformation are concentrated at the grain boundaries.

SUMMARY OF THE INVENTION

An object of the present invention is to solve the above-described problems by providing an aluminum alloy which has improved toughness and improved heat resistance as compared to conventional aluminum alloys and which can be produced on an industrial scale.

Another object of the present invention is to provide a process for producing such a tough and heat resisting aluminum alloy.

Other objects and effects of the present invention will be apparent from the following description.

The above objectives of the resent invention have been achieved by providing a tough and heat resisting aluminum alloy comprising aluminum, a transition metal element and a rare earth element, and having a modulated structure which comprises an aluminum matrix and an intermetallic compound precipitated to form a network in said aluminum matrix.

The aluminum alloy according to the present invention is generally obtained by heat treating an aluminum-based supersaturated solid solution containing a transition metal element and a rare earth element.

In order to retard the precipitation of the intermetallic compound, a metal element that has a high melting point and is slow in diffusing in an Al matrix is generally selected as one of the constituent elements. In the modulated structure of the aluminum alloy according to the present invention, the network preferably comprises intermetallic compound bands each having a width of 10 to 500 nm and being located at a spacing with neighboring bands of from 10 to 100 nm.

If the network width and spacing are out of the above respective ranges, the toughness tends to largely reduced. That is, if the width and spacing are both smaller than 10 nm, the Al alloy has sufficient strength, but may has poor ductility. If the width and spacing are greater than 500 nm and 100 nm, respectively, both ductility and strength may be greatly reduced. Also, if either one of the width and the spacing fails to meet the respective condition, both ductility and strength may be reduced.

It seems that the modulated structure is formed by spinodal decomposition in the course of precipitation or the initial stage of nucleation in the course of the precipitation. In the network structure, the interface between the Al matrix and the precipitate is coherent, and aluminum and the constituent elements of the intermetallic compound continuously change their concentrations around the coherent interface therebetween. This is because the concentration fluctuation becomes larger to induce precipitation without requiring nucleation so that there is no incubation period in the precipitation and also because the supersaturated solid solution decomposes while keeping perfect coherency with the Al matrix. Since there is no distinct interface (crystalline grain boundary) between the Al matrix and the precipitate, the anchoring of dislocations hardly concentrates at one site, and high toughness can thus be exhibited.

In selecting the combination of metal elements for forming the modulated structure, it is important that the metal elements be capable of forming a supersaturated solid solution with an aluminum matrix and be separated into two phases. The first requirement can be met by selecting an element that has an atomic radius close to that of Al. The second requirement can be fulfilled by selecting an element which is incapable of forming a solid solution or intermetallic compound with the element meeting the first requirement.

The binary state diagram of the thus selected elements is preferably of a two-phase separation type.

The aluminum alloy according to the present invention can be produced by a process which comprises the steps of:

rapid quenching and solidifying a liquid aluminum alloy containing a transition metal element and a rare earth element at a quenching rate of $10^2$ to $10^5$ K/sec to obtain an aluminum-based supersaturated solid solution; and heat treating said quenched aluminum-based supersaturated solid solution at a heat treating temperature of 473 K or higher, the temperature increasing rate to the heat treating temperature being 1.5 K/sec or higher.

The rapid quenching and solidification is preferably carried out by gas atomization or water atomization. It is preferred that the aluminum alloy obtained after the heat treatment be subjected to a hot plastic processing. The hot plastic processing is preferably a powder metal forging.

DETAILED DESCRIPTION OF THE INVENTION

Figure 1:
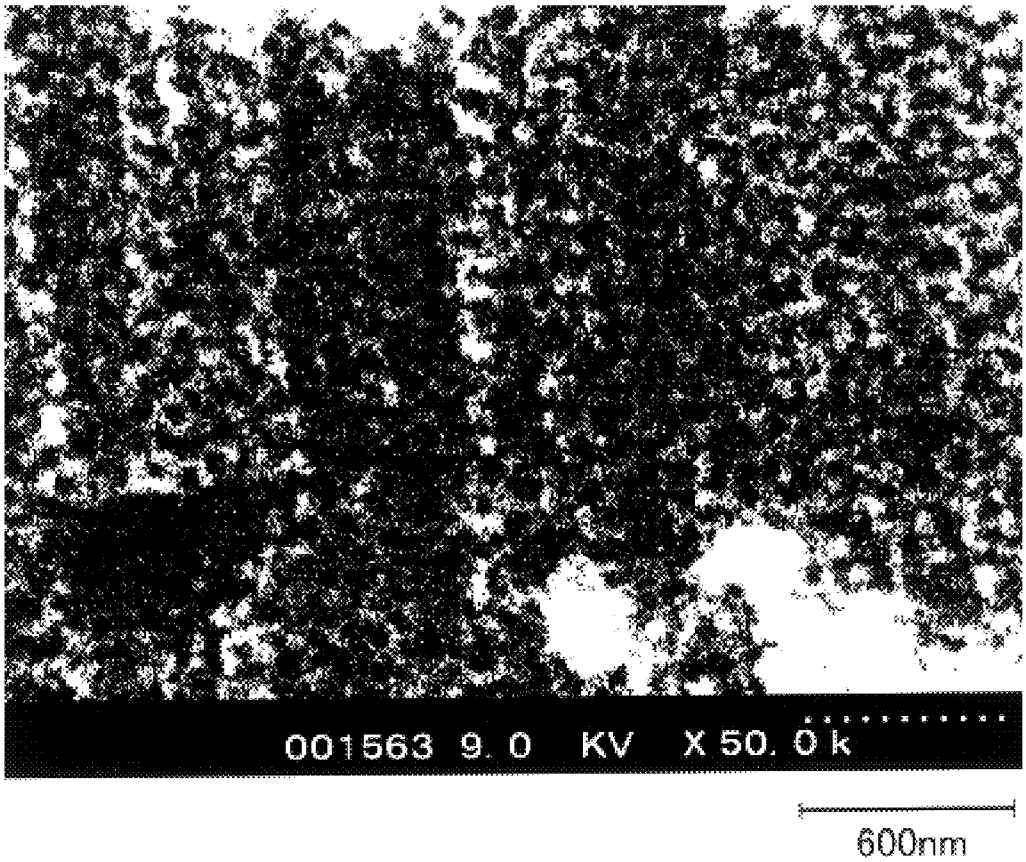
FIG. 1 is a scanning electron micrograph showing a modulated structure in which an intermetallic compound is precipitated to form a network.

The tough and heat resisting aluminum alloy of the present invention preferably has an alloy composition represented by the formula $Al_aX_bZ_c$ (wherein X represents at least one element selected from the group consisting of Ti, V, Cr, Mo, W, Nb, Ta and Zr; Z represents at least one element selected from the group consisting of Y, La, Ce, Sm, Nd and Mm (mish metal); a, b, and c are atomic percentages, in which a is from 90 to 99; b is from 0.5 to 5; and c is from 0.5 to 5). A liquid aluminum alloy having the above composition is rapidly quenched and solidified to form a supersaturated solid solution in which the metal element X having a high melting point and the element Z that separates from X are forcedly dissolved in an Al matrix.

An effective quenching rate in the preparation of a supersaturated solid solution is from $10^2$ to $10^5$ K/sec, which is suitable for industrial mass production. In the present invention, the supersaturated solid solution is used as a starting material, which is subjected to heat treatment to obtain a modulated structure at the order of nanometers.

The reasons for the limitations of atomic percentages of the constituting elements are explained below. If element X is present in greater proportions (b>5), an Al-X intermetallic compound may crystallize in the Al matrix as primary crystals. The primary crystals will be forcedly dissolved into the Al matrix to disappear if the rate of quenching is increased. However, where the rate of quenching is lower than the above-mentioned range, the primary crystals remain to cause considerable reduction of toughness. If the amount of element X is smaller than the above range (b<0.5), element X is dissolved into the Al matrix but tends to be precipitated in the form of an Al-X intermetallic compound by heat treatment, which interferes with the formation of the modulated structure. As a result, the toughness may be considerably reduced.

If the amount of element Z is larger than the above range (c>5), an amorphous phase of an Al-Z system tends to appear in the Al matrix, which hinders the formation of the modulated structure. In addition, a large number of brittle microfine precipitates of an Al—z intermetallic compound may develop by heat treatment, resulting in marked reduction in toughness. If the amount of element Z is smaller than the above range (c<0.5), element Z is dissolved into the Al matrix, but there is a tendency. that the precipitation of an Al-X intermetallic compound readily occurs as compared to the precipitation of an Al-Z intermetallic compound. Therefore, an Al-X intermetallic compound tends to be precipitated by heat treatment, which interferes with the formation of the modulated structure. As a result, the toughness may be considerably reduced.

The present invention also provides a process for producing the above-described tough and heat resisting aluminum alloy which comprises heat treating a rapidly quenched and solidified aluminum alloy comprising an aluminum-based supersaturated solid solution at a temperature of 473 K or higher. In the heat treatment, the temperature increasing rate to the heat treating temperature is 1.5 K/sec or higher.

In the process of the present invention, the above-described supersaturated solid solution obtained by rapid quenching and solidification of an aluminum alloy is used as a starting material, which is heated at a temperature of 473 K or higher with the temperature increasing rate being 1.5 K/sec or higher, to form a modulated structure exhibiting high toughness. If the heat treating temperature is lower than 473 K, the precipitation from the supersaturated solid solution is insufficient only to provide an aluminum alloy that has high strength but low ductility and poor toughness. If the heating treatment is conducted with a temperature increasing rate of less than 1.5 K/sec, the metallographic structure of the resulting aluminum alloy expands to cause a poor toughness.

The present invention will be described in greater detail with reference to the following Examples and comparative Examples, but the invention should not be construed as being limited thereto.

EXAMPLES 1 TO 15 AND COMPARATIVE EXAMPLES 16 TO 20

A metal mixture having the composition shown in Table 1 below was melted in an arc furnace and cast to obtain button-shaped ingots each weighing 1 g. The ingots were shaped into ribbon by means of a single roller melt quenching apparatus. More specifically, a quartz nozzle having a diameter of 0.5 mm at the tip was set 0.5 mm right above a copper roller. The ingots fed to the nozzle were melted in a high-frequency heating furnace to obtain a liquid aluminum alloy, and the liquid alloy was spouted at a pressure of 78 kPa ($7.95\times10^{-3}$ kgf/mm$^2$) onto the copper roller to obtain a ribbon sample. The cooling rate applied to the liquid aluminum alloy was from $10^3$ to $10^5$ K/sec.

The ribbon sample was heat treated under the conditions shown in Table 1. The heat treated ribbon sample was subjected to a tensile test on an Instron tensile tester.

The results obtained are shown in Table 2. A resolution SEM (scanning electron microscope) photograph of the modulated structure of Example 1 is shown in FIG. 1. The modulated structures of Examples 2 to 15 were similar to that of Example 1.

In the micrograph of FIG. 1, the black area is Al, and the curved white bands and the foggy white area at the right bottom portion of the micrograph are the precipitated intermetallic compound. The "modulated structure comprising an aluminum matrix and an intermetallic compound precipitated to form a network in the aluminum matrix" is the part comprising the black area (Al) and the curved white bands (intermetallic compound). The curved white bands (intermetallic compound) form the "network".

Figure 2:
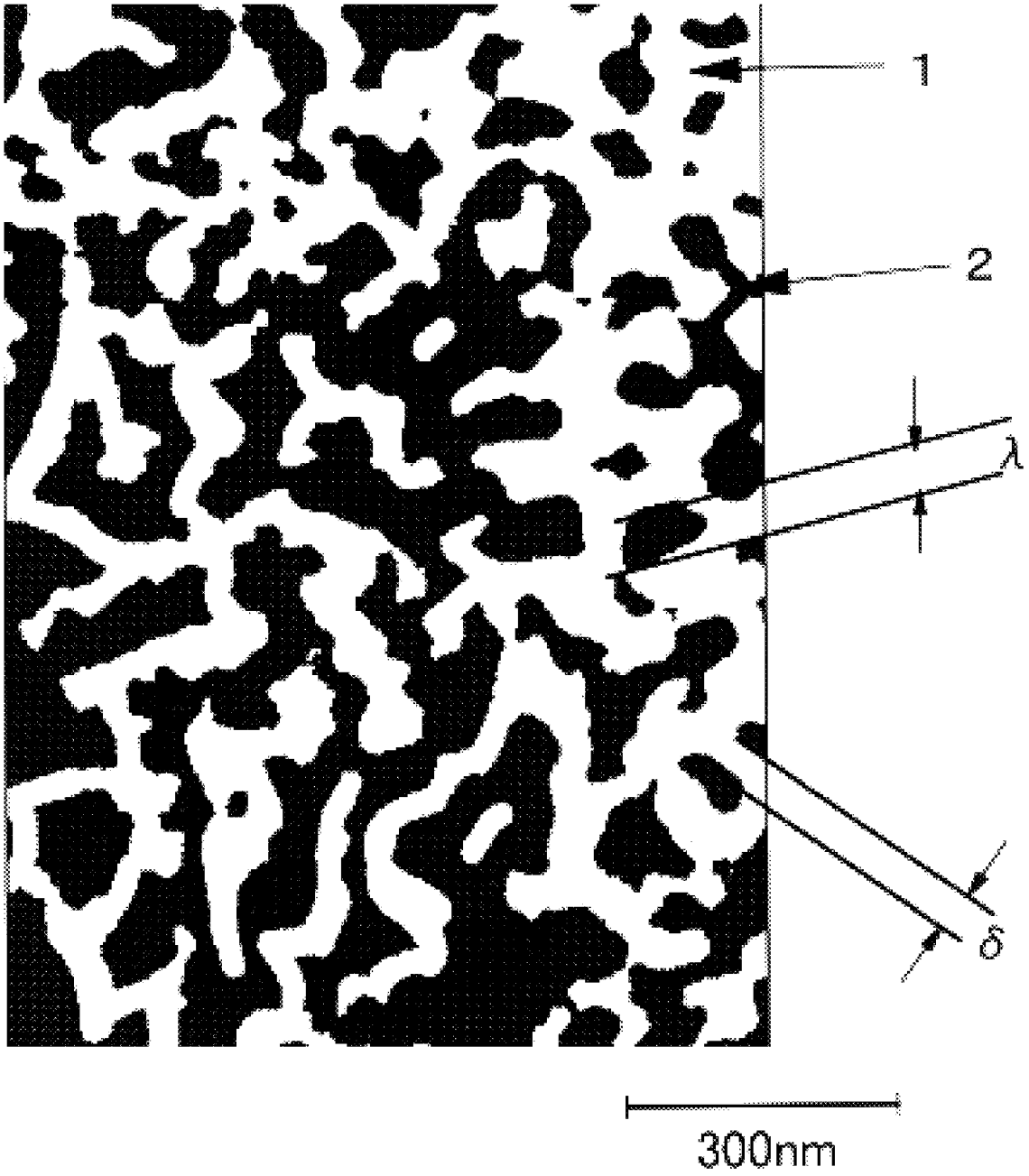
FIG. 2 is a schematic illustration of the modulated structure shown in FIG. 1

FIG. 2 is a schematically enlarged view of the network structure of FIG. 1, in which black area 2 is Al, and curved white band 1 is the intermetallic compound. The "spacing of the bands of the precipitated intermetallic compound" is indicated by λ. The spacing λ was calculated from the actual micrograph by a crossing line method (straight lines crossing at right angles are drawn on the micrograph, and an average of the lengths of the pieces of the precipitate on each line is obtained). The "width of the bands of the precipitated intermetallic compound" is indicated by δ. The spacing and width of the precipitate are shown in Table 2.

In Tables 1 and 2, Run Nos. 1 to 15 correspond to Examples 1 to 15, and Run Nos; 16 to 20 to Comparative Examples 16 to 20.

TABLE 1

| Run No. | Composition | Heat Treating Conditions Temp. (K.) | Time (sec) | X | Z | States of X and Z |
|---|---|---|---|---|---|---|
| 1 | $Al_{95}Mo_3Ce_2$ | 773 | 30 | Mo | Ce | phase separation |
| 2 | $Al_{95}Mo_3Mm_2$ | 773 | 30 | Mo | Mm | phase separation |
| 3 | $Al_{95}Ti_3Ce_2$ | 773 | 30 | Ti | Ce | phase separation |
| 4 | $Al_{95}Ti_3Mm_2$ | 773 | 30 | Ti | Mm | phase separation |
| 5 | $Al_{95}Cr_3Ce_2$ | 773 | 30 | Cr | Ce | phase separation |
| 6 | $Al_{95}Cr_3Mm_2$ | 773 | 30 | Cr | Mm | phase separation |
| 7 | $Al_{95}W_3Ce_2$ | 773 | 30 | W | Ce | phase separation |
| 8 | $Al_{95}W_3Mm_2$ | 773 | 30 | W | Mm | phase separation |
| 9 | $Al_{95}Nb_3Ce_2$ | 773 | 30 | Nb | Ce | phase separation |
| 10 | $Al_{95}Nb_3Mm_2$ | 773 | 30 | Nb | Mm | phase separation |
| 11 | $Al_{95}Mo_2Zr_1Mm_2$ | 773 | 30 | Mo, Zr | Mm | phase separation |
| 12 | $Al_{95}Mo_2W_1Mm_2$ | 773 | 30 | Mo, W | Mm | phase separation |
| 13 | $Al_{95}Mo_2Cr_1Mm_2$ | 773 | 30 | Mo, Cr | Mm | phase separation |
| 14 | $Al_{94}Mo_2W_1Nb_1Mm_2$ | 773 | 30 | Mo, W, Nb | Mm | phase separation |
| 15 | $Al_{92}Mo_2W_1Nb_1Mm_4$ | 773 | 30 | Mo, W, Nb | Mm | phase separation |
| 16 | $Al_{95}Mo_3Ce_2$ | no heat treatment | | Mo | Ce | phase separation |
| 17 | $Al_{92}Mo_5Ti_1Mm_2$ | no heat treatment | | Mo, Ti | Mm | phase separation |
| 18 | $Al_{90}Mo_2Ti_1Mm_7$ | no heat treatment | | Mo, Ti | Mm | phase separation |
| 19 | $Al_{92}Mo_5Ti_1Mm_2$ | 773 | 30 | Mo, Ti | Mm | phase separation |
| 20 | $Al_{90}Mo_2Ti_1Mm_7$ | 773 | 30 | Mo, Ti | Mm | phase separation |

TABLE 2

| Run No. | Main Structure | Precipitate of Intermetallic Compound Width δ (nm) | Spacing λ (nm) | Results of Tensile Test UTS (MPa) | Elongation (%) |
|---|---|---|---|---|---|
| 1 | modulated structure | 30 | 20 | 532 | 1.55 |
| 2 | modulated structure | 30 | 20 | 505 | 1.62 |
| 3 | modulated structure | 40 | 30 | 451 | 0.98 |

TABLE 2-continued

| Run No. | Main Structure | Precipitate of Intermetallic Compound Width δ (nm) | Spacing λ (nm) | Results of Tensile Test UTS (MPa) | Elongation (%) |
|---|---|---|---|---|---|
| 4 | modulated structure | 40 | 30 | 476 | 1.10 |
| 5 | modulated structure | 100 | 50 | 347 | 1.00 |
| 6 | modulated structure | 80 | 45 | 402 | 0.88 |
| 7 | modulated structure | 30 | 10 | 530 | 1.22 |
| 8 | modulated structure | 30 | 10 | 508 | 1.32 |
| 9 | modulated structure | 70 | 50 | 432 | 0.79 |
| 10 | modulated structure | 80 | 60 | 401 | 0.91 |
| 11 | modulated structure | 110 | 90 | 329 | 1.45 |
| 12 | modulated structure | 70 | 40 | 423 | 1.78 |
| 13 | modulated structure | 50 | 30 | 468 | 1.23 |
| 14 | modulated structure | 20 | 10 | 610 | 0.78 |
| 15 | modulated structure | 30 | 20 | 553 | 0.66 |
| 16 | supersaturated solid solution | — | — | 735 | 0.20 |
| 17 | with primary crystals | — | — | 326 | 0 |
| 18 | amorphous | — | — | 420 | 0.02 |
| 19 | with expanded primary crystals | — | — | 251 | 0 |
| 20 | microfine precipitate | — | — | 236 | 0.10 |

In designing the alloy system for forming the modulated structure having the intermetallic compound precipitated in a network, it is important that X and Z has a phase separation type binary state diagram as stated above.

Figure 3:
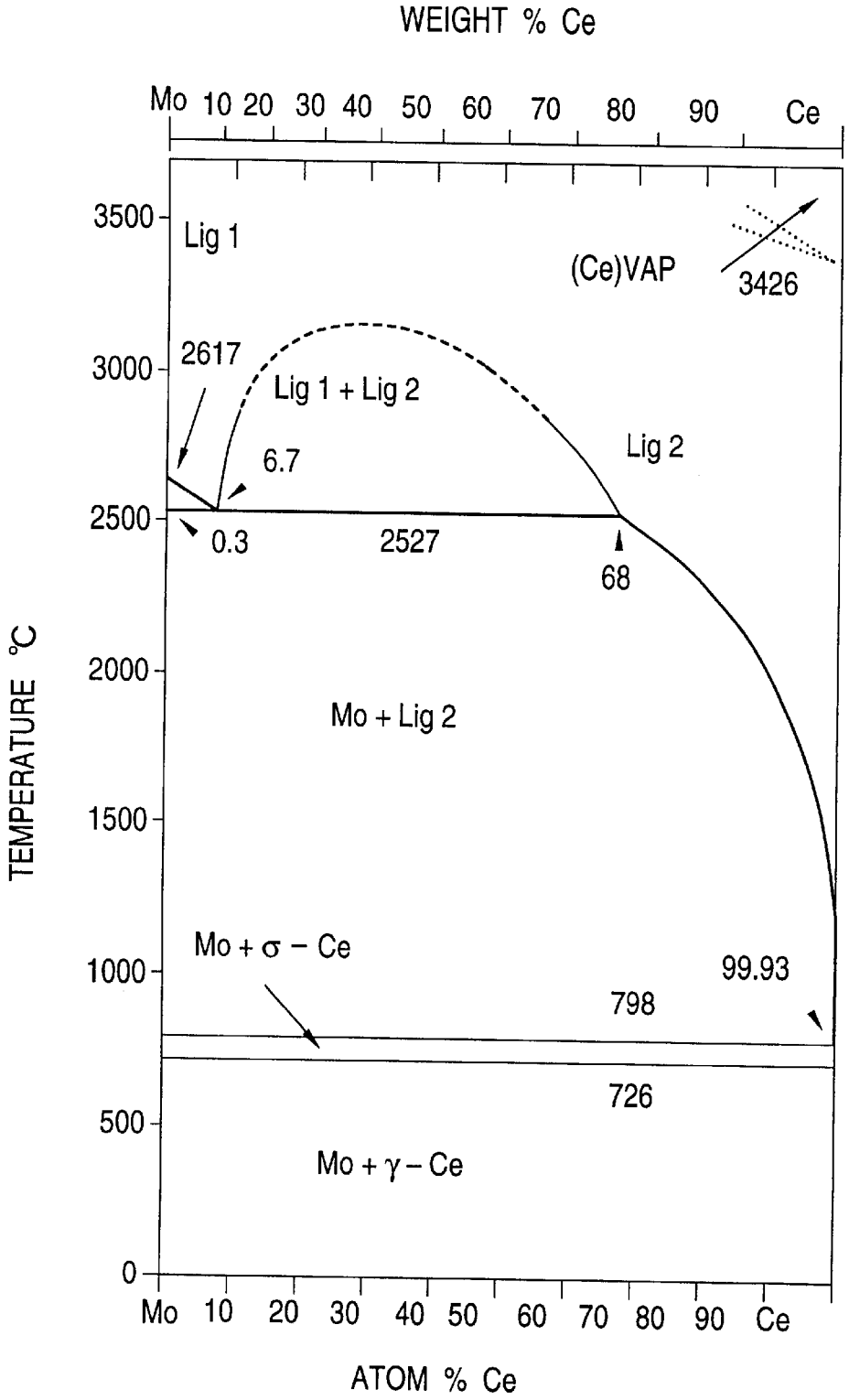
FIG. 3 is a state diagram of a Ce—Mo binary system.

FIG. 3 is a state diagram of a known Ce-Mo binary alloy system (Dr. William G. Moffatt, *The Handbook of Binary Phase Diagrams*, Genium Publishing Corporation). In the figure, temperatures are indicated based on the unit "° C.", but the relationship between the temperature indicating units "° C." and "K" is well known as "K=° C.+273.16". In this diagram, the system is separated into γ-Ce and Mo in a low temperature region. The alloy compositions shown in Table 1 above and Table 4 given below were designed so that X and Z undergo such phase separation as depicted in FIG. 3.

In order for the starting material to give a modulated structure by heating, the starting material is desirably a supersaturated solid solution. The quenching rate to solidify a liquid aluminum alloy is an important factor for preparing a supersaturated solid solution. The alloy composition should be such that provides a supersaturated solid solution when quenched at an industrial rate of $10^5$ K/sec or less.

Figure 4:
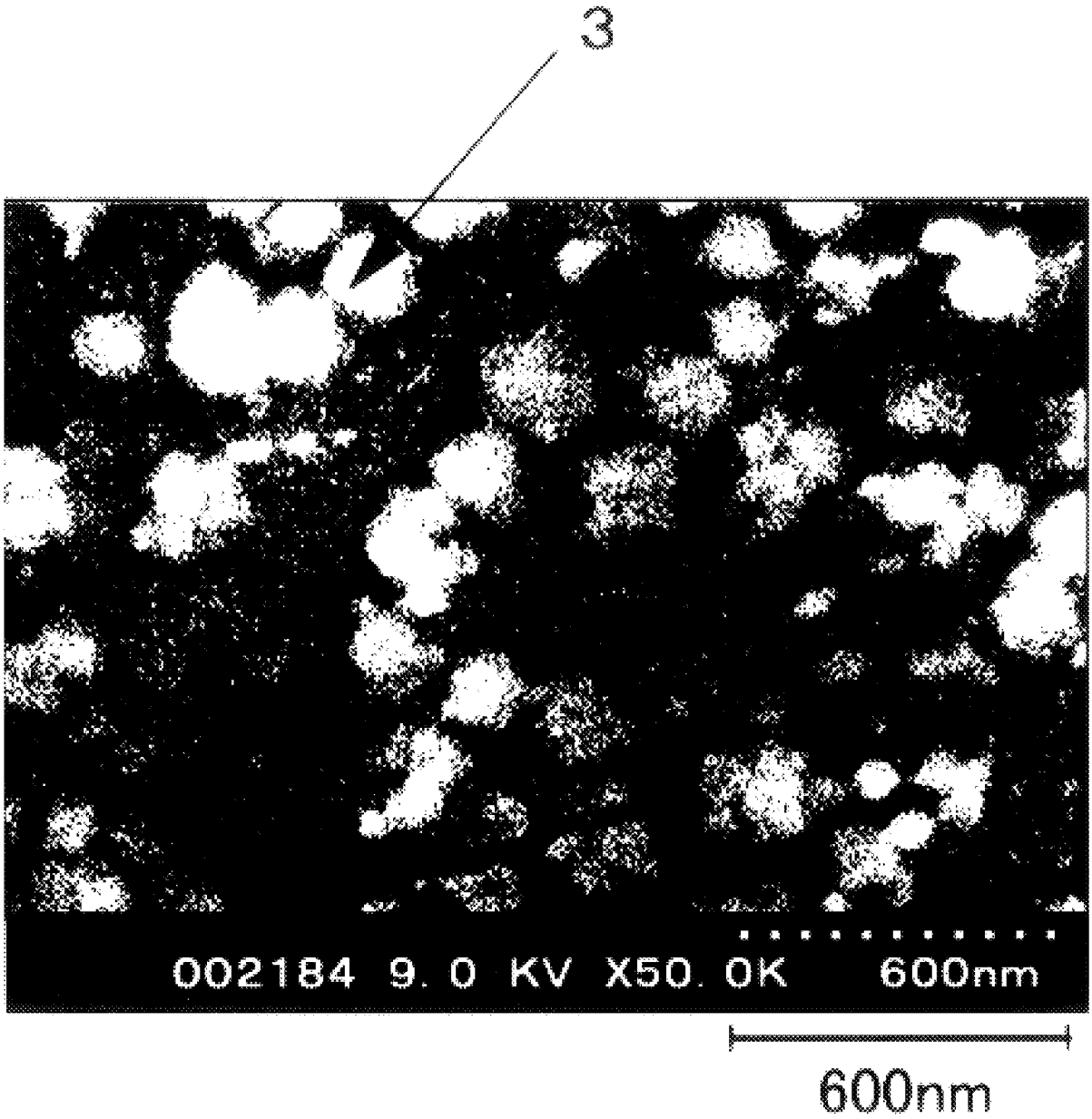
FIG. 4 is an SEM photograph of Comparative Example 17.
Figure 5:
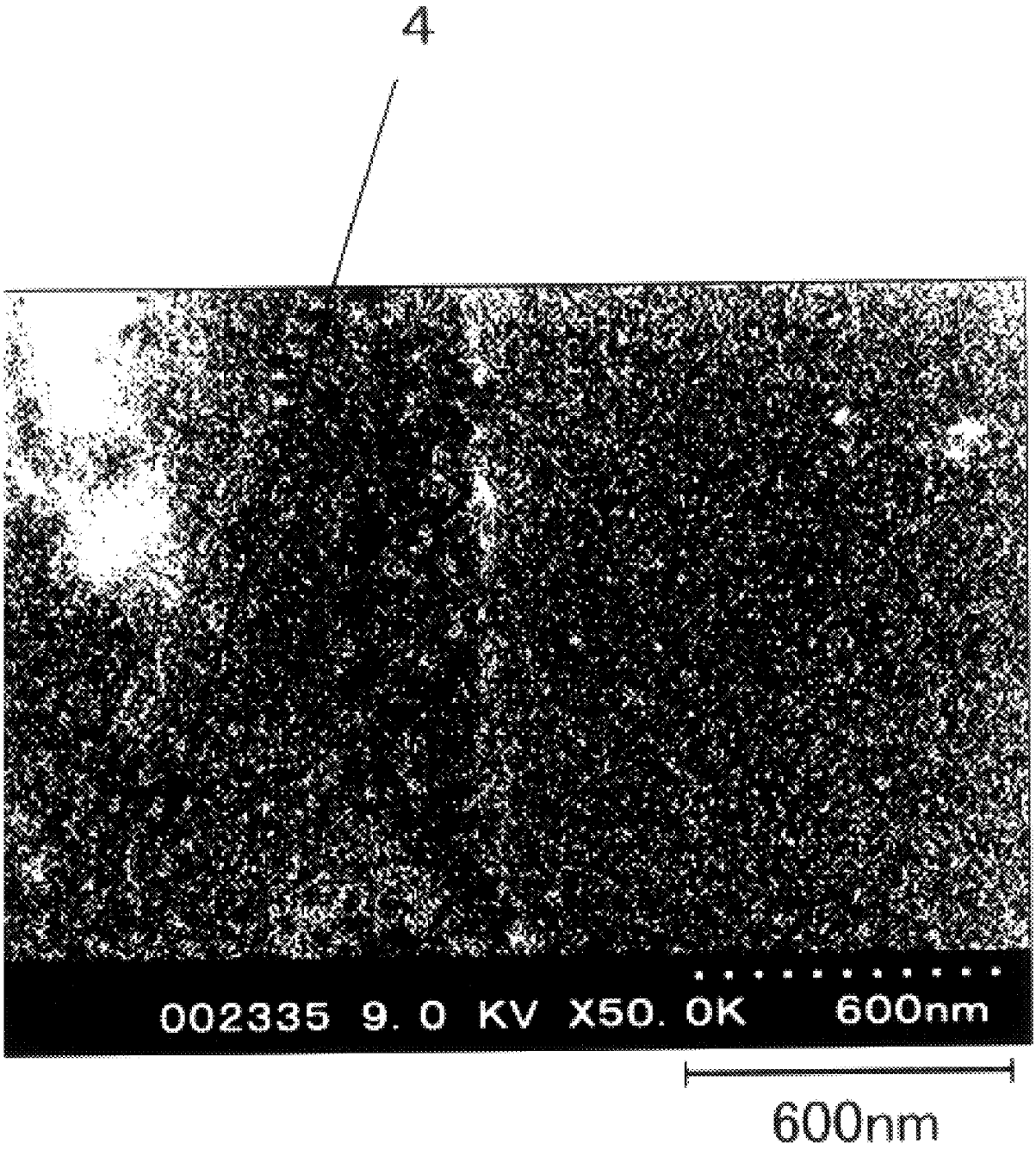
FIG. 5 is an SEM photograph of Comparative Example 18.

The SEM photographs of the structures of Comparative Examples 17 and 18 are shown in FIGS. 4 and 5, respectively. In Comparative Example 17 in which the second element X having a low solid solution limit in the Al matrix is used in a large amount, the intermetallic compound develops in the Al matrix as spherical primary crystals 3 as shown in FIG. 4. In Comparative Example 18 in which element Z is added in a large amount, the structure exhibits an amorphous phase containing microfine spherical primary crystals 4 as shown in FIG. 5. In either case, the resulting alloy is seriously inferior in tension strength and in elongation, and thus has poor toughness, as compared to Examples 1 to 15.

Figure 6:
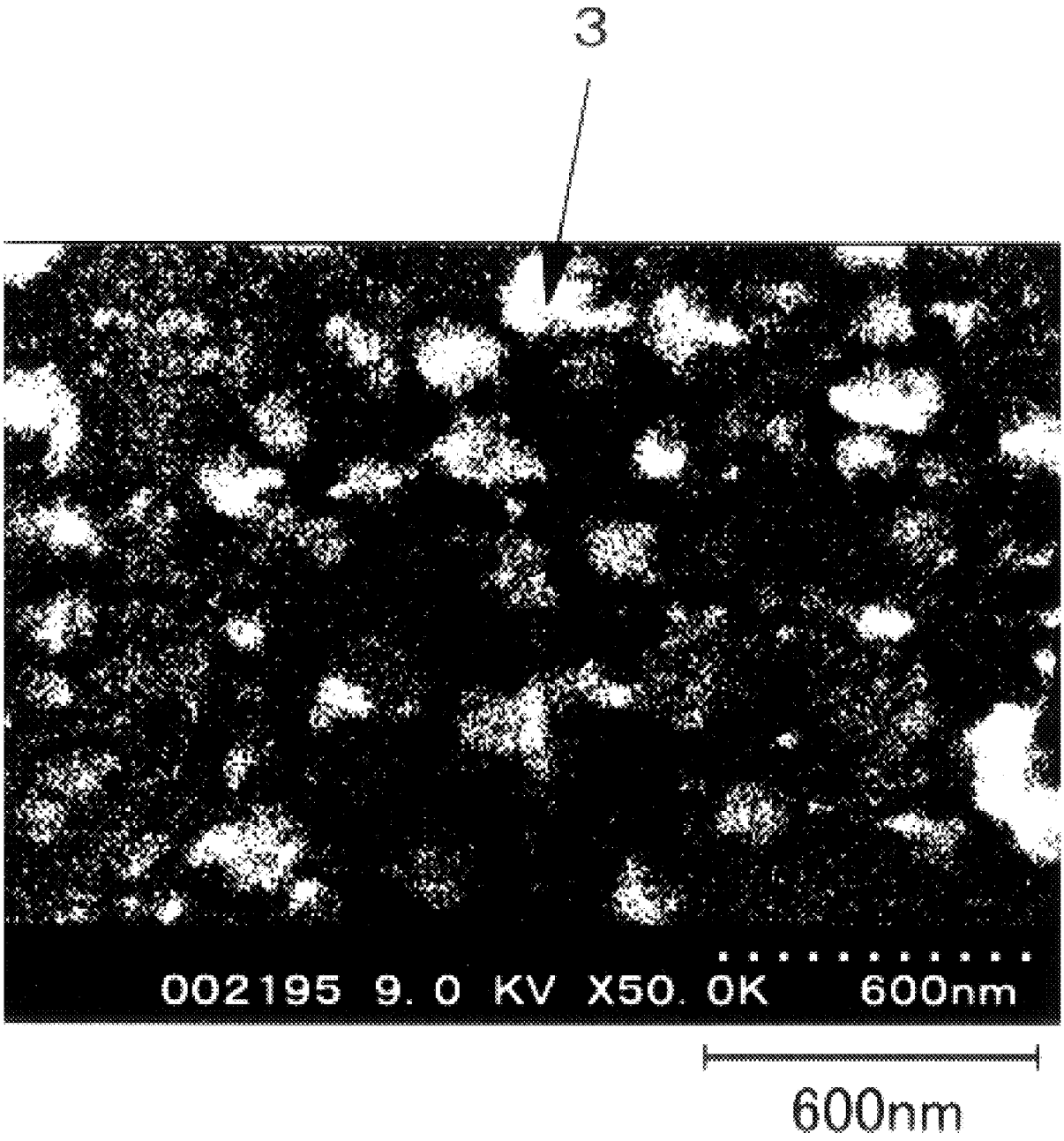
FIG. 6 is an SEM photograph of Comparative Example 19.
Figure 7:
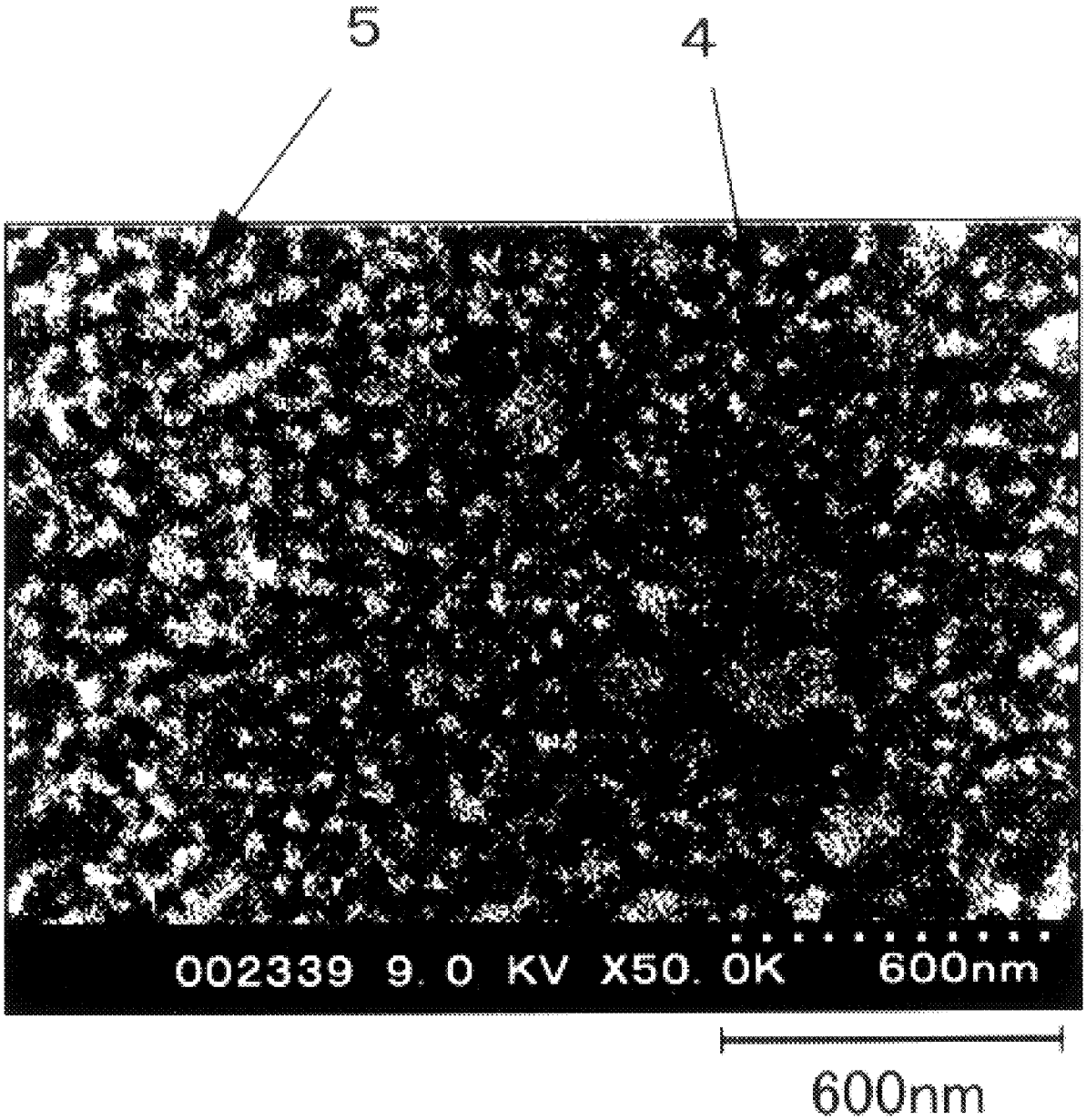
FIG. 7 is an SEM photograph of Comparative Example 20.

In selecting the alloy system for forming the modulated structure on heating, the amounts of elements X and Z are important. FIGS. 6 and 7 are the SEM photographs of the structures of Comparative Examples 19 and 20, respectively. In Comparative Example 19 in which element X is added in a large amount, the intermetallic compound appears as spherical primary crystals 3 in the Al matrix as shown in FIG. 6. In Comparative Example 20 in which element Z is added in a large amount, a large number of fine spherical precipitated particles 5 appear together with spherical primary crystals 4 as shown in FIG. 7. This is because an amorphous phase of the Al-Z system develops on rapid quenching and solidification, which is then treated at temperatures above the crystallizing temperature. In either case, the resulting alloy is considerably inferior in tension strength and in elongation, and thus has poor toughness, as compared to those of Examples 1 to 15.

Figure 8:
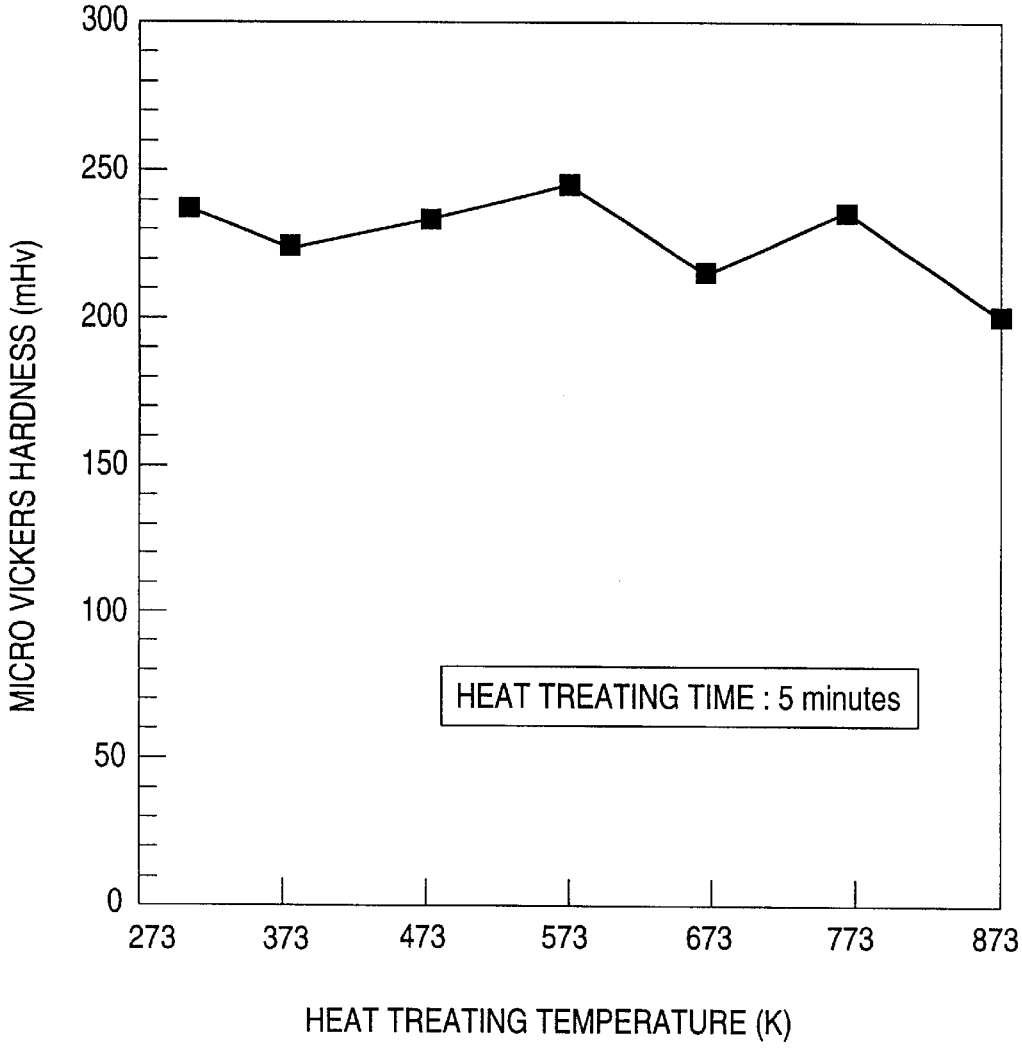
FIG. 8 is a graph showing the relationship of micro Vickers hardness versus heat treating temperatures.

FIG. 8 is a graph showing the heat treating temperature dependency of micro Vickers hardness (mHv) (load: 25 g) of the alloy of Example 1. The heat treating time in the hardness test was 5 minutes. It is seen that the aluminum alloy of Example 1 undergoes little reduction in hardness with an increase in the treating temperature, proving markedly superior in heat resistance. It was also confirmed that aluminum alloys of Examples 2 to 15 each has similar heat treating temperature dependency to that shown in FIG. 8, and hence has excellent heat resistance.

EXAMPLES 21 TO 26 AND COMPARATIVE EXAMPLES 27 TO 28

Aluminum alloy powder having the composition shown in Table 3 below was prepared by means of a gas atomizer. Gas atomization was carried out by dropping a liquid aluminum alloy from a nozzle having a diameter of 2 mm, and making nitrogen gas pressurized to 9.8 MPa (100 kgf/cm$^2$) collide against thereto. The aluminum alloy can also be powdered by water atomization in place of the gas atomization.

Separately, powder of 2014 Al alloy (the composition according to JIS H4000) was prepared in the same manner as described above. The dendrite arm spacing of the resulting powdered 2014 Al alloy was measured to estimate the actual quenching rate performed in solidifying the liquid aluminum alloy. As a result, it was confirmed that the quenching rate in solidifying a liquid aluminum alloy, at which Al alloy powder having a particle size of 65 μm was obtained, was $2\times10^4$ K/sec.

The Al alloy powder of Examples 20 to 26 thus prepared with gas atomization was sieved to obtain powder particles smaller than 65 μm. The thus obtained powder particles were press molded, and the resulting mold was rapidly heated in an induction heating furnace and forged at a bearing pressure of from 883 MPa (9 t/cm$^2$). The temperature increasing rate and the finally reached temperature for heating the mold are shown in Table 3. The mechanical properties and the metallographic structure of the thus obtained forged materials were evaluated at a room temperature.

To evaluate the mechanical properties of the resulting powder forged materials, a tensile test was conducted at room temperature with an Instron tensile tester to measure tensile strength (UTS) and elongation of each sample. Further, Charpy impact strength (unnotched) was measured with a Charpy impact tester (JIS B7722). The results obtained are shown in Table 4. In Tables 3 and 4, Run Nos. 21 to 26 correspond to Examples 21 to 26, and Run Nos. 27 and 28 to Comparative Examples 27 and 28.

It can be seen from Table 4 that the powder forged materials of Examples 20 to 26 exhibit higher tensile strength and elongation and higher Charpy impact strength than those of Comparative Examples 27 and 28. It is also understood that the powder forged materials of Examples 20 to 26 are equal to the ribbon samples of Examples 1 to 15 in terms of metallographic structure and mechanical properties.

TABLE 3

| Run No. | Composition (atom %) | Preform Heating Conditions: Final Temp. (K.) | Preform Heating Conditions: Rate of Temp. Rise (K./sec) | X | Z | State of X and Z |
|---|---|---|---|---|---|---|
| 21 | $Al_{95}Mo_3Mm_2$ | 773 | 4 | Mo | Mm | phase separation |
| 22 | $Al_{95}Ti_3Mm_2$ | 773 | 4 | Ti | Mm | phase separation |
| 23 | $Al_{95}Mo_2Zr_1Mm_2$ | 773 | 4 | Mo, Zr | Mm | phase separation |
| 24 | $Al_{95}Mo_2W_1Mm_2$ | 773 | 4 | Mo, W | Mm | phase separation |
| 25 | $Al_{95}Mo_2Cr_1Mm_2$ | 773 | 4 | Mo, Cr | Mm | phase separation |
| 26 | $Al_{92}Mo_2W_1Nb_1Mm_4$ | 773 | 4 | Mo, W, Nb | Mm | phase separation |
| 27 | $Al_{92}Mo_5Ti_1Mm_2$ | 773 | 4 | Mo, Ti | Mm | phase separation |
| 28 | $Al_{90}Mo_2Ti_1Mm_7$ | 773 | 1 | Mo, Ti | Mm | phase separation |

TABLE 4

| Run No. | Main Structure | Precipitate of Intermetallic Compound: Width δ (nm) | Precipitate of Intermetallic Compound: Spacing λ (nm) | UTS (MPa) | Elongation (%) | Charpy Impact Strength (J/cm$^2$) |
|---|---|---|---|---|---|---|
| 21 | modulated | 30 | 20 | 668 | 13 | 23 |
| 22 | " | 40 | 20 | 598 | 9 | 16 |
| 23 | " | 100 | 50 | 551 | 12 | 22 |
| 24 | " | 50 | 30 | 562 | 15 | 27 |
| 25 | " | 40 | 20 | 588 | 10 | 19 |
| 26 | " | 30 | 10 | 695 | 6 | 10 |
| 27 | expanded primary crystals | — | — | 315 | 1 | 4 |
| 28 | microfine precipitation | — | — | 296 | 2 | 6 |

The present invention provides an aluminum alloy exhibiting excellent toughness and heat resistance, which is obtained by heat treating an Al based-supersaturated solid solution and which has a modulated structure having an intermetallic compound precipitated to form a network in the aluminum matrix.

While the invention has been described in detail and with reference to specific examples thereof, it will be apparent to one skilled in the art that various changes and modifications can be made therein without departing from the spirit and scope thereof.

What is claimed is:

1. A tough and heat resisting aluminum alloy comprising aluminum, at least one transition metal element and at least one rare earth element, and having a modulated structure which comprises an aluminum matrix and an intermetallic compound precipitated to form a network in said aluminum matrix, wherein said network comprises intermetallic compound bands each having a width of 10 to 500 nm and being located at a spacing with neighboring bands of from 10 to 100 nm, wherein said aluminum alloy has a composition represented by formula:

$$Al_aX_bZ_c$$

wherein X represents at least one element selected from the group consisting of Ti, V, Cr, Mo, W, Nb, Ta and Zr; Z represents at least one element selected from the group consisting of Y, La, Ce, Sm, Nd and Mm; a, b and c represent atomic percentages in which a is from 90 to 99; b is from 0.5 to 5; and c is from 0.5 to 5.

2. A tough and heat resisting aluminum alloy comprising aluminum, at least one transition metal element and at least one rare earth element, and having a modulated structure which comprises an aluminum matrix and an intermetallic compound precipitated to form a network in said aluminum matrix, wherein said network comprises intermetallic compound bands each having a width of 10 to 500 nm and being located at a spacing with neighboring bands of from 10 to 100 nm, wherein said aluminum alloy has a composition represented by formula:

$$Al_aX_bZ_c$$

wherein X represents at least one element selected from the group consisting of Ti, V, Cr, Mo, W, Nb, Ta and Zr; Z represents at least one element selected from the group consisting of Y, La, Ce, Sm, Nd and Mm; a, b and c represent atomic percentages in which a is from 90 to 99; b is from 0.5 to 5; and c is from 0.5 to 5, and wherein the combination of X and Z is such that a binary state diagram thereof is a phase separation binary state diagram.

* * * * *